US011293187B2

(12) United States Patent
Evans

(10) Patent No.: US 11,293,187 B2
(45) Date of Patent: Apr. 5, 2022

(54) MOUNTING RAIL

(71) Applicant: Ash & Lacy Holdings Limited, West Midlands (GB)

(72) Inventor: Jonathan Evans, Staffordshire (GB)

(73) Assignee: ASH & LACY HOLDINGS LIMITED, West Midlands (GB)

( * ) Notice: Subject to any disclaimer, the term of this patent is extended or adjusted under 35 U.S.C. 154(b) by 90 days.

(21) Appl. No.: 16/622,540

(22) PCT Filed: Jun. 18, 2018

(86) PCT No.: PCT/GB2018/051685
§ 371 (c)(1),
(2) Date: Dec. 13, 2019

(87) PCT Pub. No.: WO2018/234772
PCT Pub. Date: Dec. 27, 2018

(65) Prior Publication Data

US 2021/0148119 A1 May 20, 2021

(30) Foreign Application Priority Data

Jun. 20, 2017 (GB) ..... 1709829

(51) Int. Cl.
*E04F 13/08* (2006.01)
*E04B 1/82* (2006.01)

(52) U.S. Cl.
CPC ..... *E04F 13/0826* (2013.01); *E04F 13/0805* (2013.01); *E04B 2001/8254* (2013.01)

(58) Field of Classification Search
CPC ..... E04F 13/0805; E04F 13/0826; E04F 2001/8254; E04F 13/0803; E04F 13/26; E04B 1/82; E04B 2001/8254
See application file for complete search history.

(56) References Cited

U.S. PATENT DOCUMENTS 2,054,512 A * 9/1936 Kerner ..... E04F 13/0803 52/774
2,191,267 A * 2/1940 Willson ..... E04F 13/0803 52/387

(Continued)

FOREIGN PATENT DOCUMENTS

AU 2003248179 A1 4/2004
CN 202416776 U 9/2012

(Continued)

OTHER PUBLICATIONS

International Search Report issued by ISA/EPO in connection with PCT/GB2018/051685 dated Sep. 17, 2018.

(Continued)

*Primary Examiner* — James M Ference
(74) *Attorney, Agent, or Firm* — Levenfeld Pearlstein, LLC

(57) ABSTRACT

A mounting rail for mounting tiles to a backing system of a building wall structure comprises a tile support linked with a back-fixing rail via a tile-support carrier. The tile-support carrier comprises an acoustic damper between the tile support and the back-fixing rail. This impedes the transmission of acoustic energy from the tiles to the backing system, and so improves the acoustic insolation while the mechanical stiffness of the tile-support carrying arm is maintained. The acoustic damper may be provided in the form of one or more angled bends, apertures, an obtusely angled connection of the tile-support carrier to the back-fixing rail or a connection of the tile-support carrier at an upper or lower end of the back-fixing rail, or combinations of two or more of these features.

18 Claims, 4 Drawing Sheets

(56) References Cited

U.S. PATENT DOCUMENTS

| | | | | | |
|---|---|---|---|---|---|
| 2,245,785 | A * | 6/1941 | Jentzer, Jr. | E04F 13/0803 | 52/416 |
| 3,321,883 | A * | 5/1967 | Pascucci | E04F 13/0803 | 52/774 |
| 3,672,112 | A * | 6/1972 | Sions | E04F 13/0803 | 52/712 |
| 4,262,464 | A * | 4/1981 | Ludowici | E04F 13/0803 | 52/510 |
| 4,432,181 | A | 2/1984 | Funaki | | |
| 4,553,366 | A * | 11/1985 | Guerin | E04F 13/0803 | 52/506.08 |
| 4,856,245 | A * | 8/1989 | Osawa | E04F 13/0832 | 52/386 |
| 4,890,433 | A * | 1/1990 | Funaki | E04F 13/0801 | 52/386 |
| 5,228,937 | A * | 7/1993 | Passeno | E04F 13/0801 | 156/297 |
| 5,373,676 | A * | 12/1994 | Francis | E04F 13/0862 | 52/386 |
| 5,860,257 | A * | 1/1999 | Gerhaher | E04F 10/10 | 52/235 |
| 6,098,363 | A * | 8/2000 | Yaguchi | E04F 13/0801 | 52/385 |
| 6,158,915 | A | 12/2000 | Kise | | |
| 6,315,489 | B1 * | 11/2001 | Watanabe | E04F 13/0846 | 403/381 |
| 6,460,311 | B1 * | 10/2002 | Ito | E04F 13/0826 | 52/489.1 |
| 6,491,172 | B2 * | 12/2002 | Chance | A47F 5/0846 | 211/87.01 |
| 6,615,560 | B2 * | 9/2003 | Ito | E04F 13/0846 | 52/506.06 |
| 6,951,086 | B2 * | 10/2005 | Passeno | E04F 13/0862 | 52/302.3 |
| 7,665,260 | B2 * | 2/2010 | Hikai | E04F 13/0826 | 52/506.05 |
| 7,849,651 | B2 * | 12/2010 | Fujito | E04F 13/0803 | 52/506.06 |
| 8,826,620 | B2 * | 9/2014 | Krause | E04F 13/0817 | 52/506.08 |
| 8,833,025 | B2 * | 9/2014 | Krause | E04F 13/0826 | 52/506.08 |
| 9,016,020 | B1 * | 4/2015 | Yang | E04F 13/072 | 52/511 |
| 9,422,730 | B2 * | 8/2016 | Curtis | E04F 19/024 | |
| 9,464,442 | B1 * | 10/2016 | Olczyk | E04F 13/0835 | |
| RE47,495 | E * | 7/2019 | MacKenzie | E04B 1/7076 | |
| 2001/0045075 | A1 * | 11/2001 | Watanabe | E04F 13/0826 | 52/712 |
| 2002/0023398 | A1 * | 2/2002 | Ito | E04F 13/0864 | 52/220.1 |
| 2002/0032999 | A1 * | 3/2002 | Ito | E04F 13/0803 | 52/474 |
| 2002/0046536 | A1 * | 4/2002 | Hotta | E04F 13/0864 | 52/698 |
| 2002/0194802 | A1 * | 12/2002 | Cousin | E04B 9/303 | 52/287.1 |
| 2003/0150179 | A1 * | 8/2003 | Moreno | E04F 13/0808 | 52/235 |
| 2004/0050003 | A1 * | 3/2004 | Passeno | E04F 13/14 | 52/384 |
| 2004/0065035 | A1 * | 4/2004 | De Vlam | E04F 13/0862 | 52/384 |
| 2007/0163188 | A1 * | 7/2007 | Price | E04F 13/0821 | 52/169.12 |
| 2007/0163203 | A1 * | 7/2007 | Price | E04F 13/0821 | 52/834 |
| 2012/0317909 | A1 * | 12/2012 | MacKenzie | E04B 1/7076 | 52/288.1 |
| 2014/0318063 | A1 * | 10/2014 | Case | E04B 1/82 | 52/309.14 |
| 2014/0318077 | A1 * | 10/2014 | Case | E04B 1/74 | 52/843 |
| 2015/0191911 | A1 * | 7/2015 | Mann | E04F 13/0805 | 52/475.1 |

FOREIGN PATENT DOCUMENTS

| | | | | |
|---|---|---|---|---|
| EP | 0562779 | A1 | 9/1993 | |
| EP | 1188878 | A1 | 3/2002 | |
| FR | 2678662 | A1 | 1/1993 | |
| FR | 3071264 | A1 * | 3/2019 | E04F 13/0826 |
| GB | 2328958 | A * | 3/1999 | E04F 13/0805 |
| GB | 2552671 | A | 2/2018 | |
| JP | 2002167944 | A * | 6/2002 | |
| KR | 101088417 | B1 | 12/2011 | |
| WO | 2016166395 | A1 | 10/2016 | |

OTHER PUBLICATIONS

Written Opinion issued by ISA/EPO in connection with PCT/GB2018/051685 dated Sep. 17, 2018.

International Preliminary Report on Patentability and Written Opinion issued by ISA/EPO in connection with PCT/GB2018/051685 dated Dec. 24, 2019.

European Search Report issued by EPO in connection with EP Application No. 18734917.0 dated Jul. 15, 2021.

* cited by examiner

MOUNTING RAIL

CROSS-REFERENCE TO RELATED APPLICATION DATA

This application is a US National Stage Application of PCT/GB2018/051685, filed Jun. 18, 2018, titled Mounting Rail, which claims the benefit of and priority to Great Britain Application No. 1709829.4, filed Jun. 20, 2017, title Mounting Rail, the disclosures of which are incorporated herein in their entirety.

FIELD OF THE INVENTION

The present invention relates to a mounting rail, or a cladding rail, of the type to be mounted onto the walling structures, to support external cladding or tiles. More particularly, the present invention relates to mounting rails that provide an improved sound attenuation between the external cladding and the walling structure.

BACKGROUND

Cladding rails, or mounting rails for cladding, are used to mount cladding tiles or brick tiles to an external walling structure, usually to externally-facing mullions. Cladding tiles and brick tiles constitute the 'outer skin' and provide functionality such as rain protection and are used as a decorative finishing.

Support structures for cladding tiles require a certain degree of rigidity to securely hold the tiles in place throughout the lifetime of the structure. In addition, for cladding intended to mimic the appearance of a brick wall, the joints between cladding tiles may be filled in with mortar to provide an appearance of a genuine brick-and-mortar wall. The underlying support structure must be sufficiently rigid to prevent cracks appearing in the infill material.

The present invention seeks to provide advanced mounting structures that maintain a sufficient degree of rigidity.

SUMMARY OF THE INVENTION

In accordance with a first aspect of the present invention, there is provided a mounting rail as defined in claim 1. The mounting rail is for mounting tiles to be provided to a backing system of a building wall structure.

The mounting rail comprises a tile support and a back-fixing rail, the tile support being linked to the back-fixing rail via a tile-support carrier. The tile-support carrier comprises an acoustic damper between the tile support and the back-fixing rail.

It is understood that the mounting rail has a longitudinal extension. The principal parts of the mounting rail can be described with reference to a cross-section perpendicular to the longitudinal extension.

The mounting rail is intended for horizontal mounting to a backing system, the backing system usually consisting of laterally spaced apart, vertically extending mullions, by way of the back-fixing arrangement. The mounting rail carries tiles or cladding that is to form the exterior skin of a building structure.

The mounting rail is of the type capable of supporting the base of a first tile to be provided and of retaining the top of a second tile to be provided, eg by sitting between an upper row of tiles and a lower row of tiles.

A prior art mounting rail design is illustrated in FIG. 1. FIG. 1 shows a mounting rail 1, which is a rail with a general "double-T" or "H" profile in section. The mounting rail 1 comprises a tile support 2 and a back-fixing rail 5, and the tile support 2 is connected to the back-fixing rail 5 via a tile-support carrier 6. The back-fixing rail 5 comprises a generally flat face to be mounted to a walling structure, eg a plurality of mullions, such that the back-fixing rail 5 extends horizontally across a plurality of vertically extending and horizontally spaced apart mullions of the walling structure. The back-fixing rail comprises a top end 8 and a lower end 9. The tile-support carrier 6 extends from a position partway within (ie about halfway between the top end 8 and the lower end 9, in the reading orientation of FIG. 1) the back-fixing rail 5, such that there is sufficient space to accommodate fixing means (bolts or screws) on the back-fixing rail 5 above and below the tile-support carrier 6. The tile-support carrier 6 extends away from the mullions of the walling structure at a right angle in the manner of a cantilever and comprises, at its distal end (distal=away from the mullion side) an upward-extending support rail 3 to engage the base of a first tile to be provided, and a downward-extending support rail 4 to engage the top of a second tile to be provided. Because the tile-support carrier extends from the back-fixing rail at a right angle, the upper surface of the tile-support carrier 6 provides a practically horizontal shelf on which the first tile can be seated, while the support rail 3 allows a tile to be secured at a fixed distance from the mullion. Turning to the back-fixing rail 5, this comprises at its lower end 9 a spring arm 7 protruding distally so as to be able to push against, and thereby bias distally, the top of the second tile to be provided. The spring arm 7*a* is not intended to support the weight of a brick and so is not a tile-carrying structure.

When mounted to the walling structure, rows of tiles are carried between two mounting rails, ie carried between the lower tile support of an upper mounting rail and the upper tile support of a lower mounting rail. The tile supports are unitarily connected with tile-support carriers which are unitarily connected with the back-fixing rail. When the back-fixing rail is mounted on a walling system, thereby the tiles are fixed to the walling system. In other words, a tile support carries the base of a first tile to be provided and retains the top of a second tile to be provided.

FIG. 2 shows a plurality of prior art mounting rails 1*a* and 1*b* used to mount brick tiles 100 to a walling structure 110. The numerals in FIG. 2 are used to indicate components corresponding to those in FIG. 1, using an additional suffix '-a' for parts of an upper mounting rail and the suffix '-b' for parts of a lower mounting rail. A brick tile 100 is held between a first mounting rail 1*a* and a second mounting rail 1*b*. The brick tile 100 is purposefully profiled with a top lip 104 and a base groove 103. The top lip 104 is recessed relative to the outer surface of the brick 100 to allow the top lip 104 to slip behind the down-facing support rail 4*a* of the first mounting rail 1*a*. The base groove 103 can be slid over the upward-facing support rail 3*b*. The spring arm 7*a* of the first mounting rail 1*a* biases the top lip 104 distally and so the brick 100 is held in place at a fixed distance relative to the walling structure 110. The FIG. 2 arrangement is sufficiently rigid that joints 102 between two brick tiles may be filled in with mortar to provide an appearance of a genuine brick wall.

The present inventor has discovered that the conventional arrangement exhibits a poor sound insulating performance, because sound can travel from the tile carrier to the backing fixing with little inhibition. Sound propagation is exacerbated because the structures are made from rigid metal.

Thus, any 'knocking' against an external tile is transmitted onto the underlying backing structure and may even be amplified.

Illustrating the problem using the example of FIG. 2, the tile-support carriers 6*a* and 6*b* protrude at a right angle relative to the back-fixing rail 5, in order to provide a horizontal seating surface for the bricks 100. As the walling structure 110 and the mounting rails 1*a*, 1*b* are made from metal and because they are in direct contact, it can be imagined that vibrations picked up by a brick 100 are transferred practically without attenuation from the tile support 2 via the tile-support carrier 6*a* (and/or 6*b*, respectively) onto the walling structure 110.

Surprisingly, a good degree of noise attenuation can be achieved by including a sound damper in the tile-support carrier. The sound damper is an arrangement that impedes the direct sound propagation via a solid, right-angled structure from the tile carrier to the back-fixing rail.

The sound damper may be provided in the form of a structure provided in at least a portion of the longitudinal extent of the tile-support carrier. The structure may comprise an obtusely angled bend. The structure may comprise one or more apertures. Such a structure is believed to impede the direct pathway sound can travel from the tile support along the tile-support carrier structure to the back-fixing rail. It is believed that the effect may be achieved by features that provide additional degrees of freedom allowing vibrations to dissipate, such as angular features that interrupt the unidirectional propagation of sound within a metal medium, and/or apertures that reduce the mechanical stiffness of the material between the tiles and the backing system. Such structures are believed to increase the modes of vibration that allow sound energy to dissipate before it reaches the backing structure.

At the same time, a surprising finding was that the mechanical strength of the tile-support carrier is sufficient to keep tiles in place, even if the tile-support carrier is provided with a sound attenuating structure. In this regard, for tiles or cladding intended to mimic the appearance of a brick wall, and therefore with mortar infill material between tile joints, it can be imagined that too much leeway, particularly in the horizontal direction perpendicular to the backing system, will allow cracks to appear in the mortar, which is undesirable.

Surprisingly, the provision of an acoustic damper does not negatively affect the structural rigidity required to keep the tiles in place. It is believed that this is a result of the different order of magnitudes involved. Acoustic vibrations are expected to cause vibrations in the micrometre range, and these can be attenuated to a sufficient extent by the acoustic dampers without reducing the structural rigidity.

In some embodiments, the acoustic damper comprises an angled bend between the tile support and the back-fixing rail.

An angled bend may be understood as an angulation, a curve, turn or deflection, at an angle (other than a straight 180 degree angle) in the neutral position of the tile-support carrier. The acoustic damper may comprise one or more angled bends. The bends may extend along the longitudinal extent of the mounting rail.

In some embodiments, the tile-support carrier extends from the back-fixing rail at an acute angle or at an obtuse angle.

In some embodiments, the tile support is connected to the tile-support carrier at an acute angle or at an obtuse angle.

This reduces the rigidity resisting a horizontal push, eg of a person pushing or knocking against the brick-wall type cladding. Also, a connection at an angle other than a right angle increases the distance between the tile support and the back-fixing rail, ie relative to a right-angle shortest distance between two parallel planes. This provides a larger area for sound dampers, eg a bend, ribs, or apertures, or combinations of two or more of these, without increasing the spacing between a tile and the backing structure.

In some embodiments, the tile-support carrier extends from an upper end or from a lower end of the back-fixing rail.

Thereby, the tile-support carrier is not structurally anchored at two sides (upper and lower side) to the back-fixing rail, ie with portions of the back-fixing rail extending at both the upper and lower side of the tile-support carrier. Instead, the tile-support carrier extends from only one end (upper end or lower end) of the back-fixing rail. This is believed to allow the tile-support carrier to vibrate in slightly more modes, thereby facilitating the dissipation of sound energy before it reaches the back-fixing rail.

In some embodiments, the mounting rail comprises a tile-biasing element biasing a tile away from the backing system. An acoustic damper may be provided in the tile-biasing element.

A tile-biasing element facilitates a quick alignment of tiles. However, the tile-biasing element may provide a channel from a tile to the backing system for at least some acoustic energy.

Thus, the provision of an acoustic damper on the tile-biasing element improves the overall attenuation of acoustic vibration of the mounting rail.

In some embodiments, the acoustic damper comprises an angled bend on the tile-biasing element between a tile-contacting surface and the back-fixing rail.

In some embodiments, the tile-biasing element is carried on the tile-support carrier spaced apart from a backing-system contacting plane of the back-fixing rail.

It will be understood that the back-fixing rail is intended for mounting to the backing system, and as such has a plane extending in the vertical direction of the backing system. The tile-biasing element may be carried on the back-fixing rail or on the tile support. The tile support extends from the back-fixing rail and this allows the tile-biasing element to be carried on the tile support in a manner that extends back (back is in the direction of the backing system) less far than the tile support extends from the back-fixing rail, such that the biasing element is distanced from the backing system when the mounting rail is mounted to the backing system.

The space between the biasing element and the backing system may be in the region of a millimetre, or somewhat less than a millimetre. Acoustic vibrations are in the region of micrometres and, as such, much less than the space between the biasing element and the backing system. The spaced-apart relationship has the effect that the biasing element may acoustically vibrate while making it practically impossible for such vibrations to be mechanically transferred to the backing system.

At the same time, even though a small space provides a leeway allowing a tile element to be pushed towards the mullion structure, in practice the leeway is sufficiently small to reduce the likelihood of a crack appearing if a tile element is pushed against the backing system.

In some embodiments, the acoustic damper comprises one or more apertures.

The acoustic damper may be provided by apertures on the tile-support carrier and/or the acoustic damper on the tile-biasing element.

Such apertures can be readily distinguished from screw holes that would conventionally be expected on a mounting rail, because conventional screw holes are on the back-fixing rail so as to allow the mounting rail to be mounted to a mullion, ie at a right angle to the mullion surface.

Apertures provided for acoustic dampening on the tile-support carrier and/or on the tile-biasing element and would not be suitable as screw-holes for mounting to the backing structure, because the tile-support carrier and the tile-biasing element are not abutted against a mullion.

In some embodiments, the plurality of apertures is spaced apart in the longitudinal extension of the mounting rail.

The present inventor has discovered that the longitudinally spaced apart apertures have an acoustic dampening effect, ie an effect that reduces the transfer of acoustic vibrations from the tiles to be provided to the backing system. It is believed that this effect is observed because the longitudinally spaced-apart apertures reduce the mechanical stiffness of the tile-support carrier and/or because the apertures provide additional degrees of vibrating freedom that allow vibration energy to dissipate in modes other than directly to the backing system.

The apertures are spaced apart, such that bridging material between the apertures provides mechanical strength, such that the mechanical stiffness of the tile-support carrying arm is not adversely affected.

In some embodiments, the apertures are constituted by slots with an elongate extent in the longitudinal extension of the mounting rail.

In some embodiments, the apertures are constituted by an array of slots arranged sequentially in a longitudinal extension of the mounting rail.

In some embodiments, two adjacent apertures are spaced apart by a bridge distance less than the length of at least one of the two adjacent apertures.

It will be understood that, in a longitudinal extension, the apertures are spaced apart by an aperture pitch. The space of material between two adjacent apertures, or "bridge" corresponds to the difference between aperture pitch and aperture length. The acoustic-dampening effect is improved with larger apertures, ie if the aperture length increases in relation to the aperture pitch. For instance, if the aperture length is half the aperture pitch, the bridge length corresponds to the aperture length. The aperture length may exceed the bridge length. Eg, the ratio of aperture length to aperture pitch may be 1:2, 2:3, 3:4, 4:5, or 5:6. The longer the bridge, the better the structural stiffness of the mounting rail. Which ratio of aperture length to aperture pitch is appropriate for a given mounting rail system depends on the characteristics of the tile/panel to be provided, eg size, material (mass), and tile thickness, and whether or not, and in which manner, the apertures are combined with other sound damper features such as angled bends.

In some embodiments, two or more adjacent apertures have different shapes, the two or more adjacent apertures are arranged in a sequence of apertures, and the sequence of apertures is repeated along the longitudinal extent of the mounting rail.

The apertures may have different shapes, eg elongate slots of different length may be used to reduce the likelihood of harmonic vibrations travelling in the longitudinal extent of the mounting rail.

In some embodiments, alternating apertures have the same shape.

In some embodiments, the apertures have the same shape.

The apertures may have different shapes, or alternating shapes, or the same shape. This allows the length of the apertures to be tailored to a particular tile size, to reduce harmonic effects that may affect an acoustic dampening effect.

In some embodiments, the mounting rail comprises one or more rows of apertures.

Rows of apertures may be provided on either side of an angled bend.

In some embodiments, the mounting rail comprises a plurality of rows of apertures, wherein the apertures of a first row are longitudinally offset from the apertures of a second row.

For apertures with a length shorter than the bridge distance, this allows the material between apertures to overlap to improve mechanical stiffness. For apertures with a length exceeding the bridge distance, this allows a tile-support carrier and/or tile-biasing element to be provided in which no section (perpendicular to the longitudinal extent) provides a direct, perpendicular pathway for sound to travel from the tile-carrier to the backing system.

In some embodiments, the mounting rail is formed from extruded metal.

In some embodiments, the mounting rail is formed from sheet metal.

In some embodiments, the mounting rail is formed from aluminium.

In accordance with a second aspect of the invention, there is provided a walling structure comprising one or more mounting rails according to the first aspect of the invention.

DESCRIPTION OF THE FIGURES

Exemplary embodiments of the invention will now be described with reference to the Figures, in which.

DESCRIPTION

Figure 3:
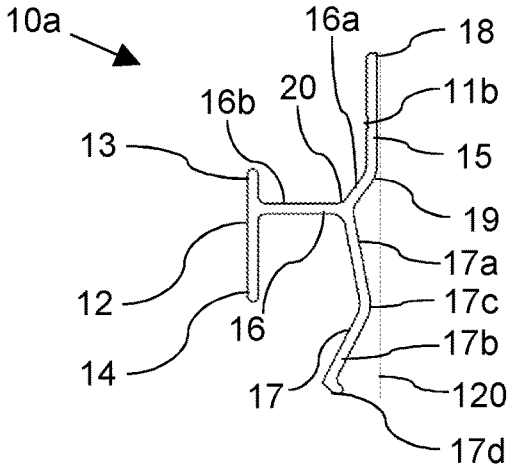
FIG. 3 shows a schematic section of an embodiment.

FIG. 3 shows a cross section of a cladding rail 10*a* constituting a mounting rail of the invention. The cladding rail 10*a* is an extruded profile. The cladding rail 10*a* is to be mounted to a series of laterally spaced apart vertical mullions indicated in FIG. 3 by a back-fixing plane 120. Starting from the back-fixing plane 120, the cladding rail 10*a* comprises a back-fixing rail 15 with a mullion-facing flat, that, when mounted to a mullion, faces in the direction of the back-fixing plane 120. The back-fixing rail 15 comprises, in the reading orientation of FIG. 3, a top end 18 and a lower end 19. About half-way between the top end 18 and the lower end 19 there is indicated a groove 11*b* on the face opposite the mullion-facing flat. Fixtures such as screws (not shown in FIG. 3) may be mounted approximately at the level of the groove 11*b*.

From the back-fixing rail 15 extends towards the distal side (ie, towards the left in FIG. 3) a carrier arm 16. The carrier arm 16 constitutes a tile-carrier support. The carrier arm 16 extends from the lower end 19 and is inclined down at an obtuse angle (ie the included angle between the carrier arm 16 and the back-fixing rail 15 is obtuse). Moving along the carrier arm 16 in a distal direction, the carrier arm 16 comprises a Y-branch 20 from which two branches extend, one of the branches is an upward bend of the carrier arm 16 and the other branch is a down-facing tail 17. The description of the carrier arm 16 will follow first before turning to the tail 17. At the Y-branch 20 the carrier arm 16 bends upward from its downward incline so as to extend practically horizontally in the distal direction. The upward bend constitutes an angled bend. The Y-branch 20 thus separates the carrier arm 16 into a proximal arm portion 16*a* between the back-fixing rail 15 and the Y-branch 20, and a distal arm portion 16*b* extending distally from the Y-branch. The distal arm portion 16*b* is practically perpendicular to the plane of the back-fixing rail 15 and, thus, to the back-fixing plane 120 when mounted to a mullion.

At the distal (left in FIG. 3) end of the distal arm portion 16*b*, the carrier arm 16 carries an upper (upward-extending) lip 13 and a lower (downward-facing) lip 14. The upper lip 13 and lower lip 14 extend from the distal arm portion 16*b* at an approximately right angle so that the distal arm portion 16, the upper lip 13 and the lower lip 14 together provide a flanged section, or sideway "T" section (the "T" lying on its left side), and the side-ways T provides a tile support 12. The upper side of the distal arm portion 16*b* provides a horizontal seating surface for a first (upper) tile to be provided and the upper lip 14 can slot into a groove of the first tile to be provided.

Turning now to the tail 17 extending down from the Y-branch 20, the tail 17 extends generally downward (in the reading orientation of FIG. 3). The tail 17 comprises a bend 17*c* partway, about half of its length. Above the bend 17*c*, the tail 17 comprises an upper tail portion 17*a* between the Y-branch 20 and the bend 17*c*. Below the bend 17*c*, the tail 17 comprises a lower tail portion 17*b*. The tail 17 constitutes a tile-biasing element. As illustrated in FIG. 3, the tail is not connected straight to the back-fixing rail 15, but to the carrier arm 16 at the Y-branch 20. From the Y-branch 20, the upper tail portion 17*a* inclines towards the back-fixing plane 120, and the lower tail portion 17*b* is inclined away from the back-fixing plane such that the bend 17*c* is not in contact with the back-fixing plane 120. For instance, the bend 17*c* may be spaced from the back-fixing plane by about 1 mm. As such, the tail 17 is spaced apart from the plane of the mullion-facing side (ie the backing-system facing plane) of the back-fixing rail 15.

At its lower end, the lower tail portion 17*b* of the tail 17 comprises a back-folded lip 17*d* to provide a smooth contact line with a tile to be provided. An upper groove of a second tile may be slotted onto the lower lip 14 and is biased distally by the tail 17.

By way of the Y-branch 20, the obtusely angled connection of the carrier arm 16 to the back-fixing rail 15, and the connection at the lower end 19 rather than at the centre of the back-fixing rail 15, vibrations picked up at the tile support 12 are not transmitted directly to the back-fixing rail 15. Instead, the angled bends provided by the Y-branch 20 and by the obtusely angled connection at the lower end 19 prevent a straight sound path and therefore provide a de-coupling effect to allow sound energy (vibrations in the micrometre region) to dissipate. As such, the Y-branch 20, the angled connection and the connection at the lower end 19, each individually and in combination, constitute sound dampers of the invention. Furthermore, sound dampers are provided by the tail 17 constituting a tile-biasing element. The tail 17 is in contact with a tile to be provided, yet not connected straight to the back-fixing rail 15. As such, the proximal arm portion 16*a* is the only part immediately connected to the back-fixing rail 15. The tail 17 is spaced from the back-fixing plane 120 of the back-fixing rail 15. Also, the tail 17 comprises a bend 17*c* between the tile-contacting end and the Y-branch 20 providing an additional de-coupling. It will be understood that one or more of these features can be combined to optimise a sound-dampening effect for a particular cladding configuration.

Figure 4:
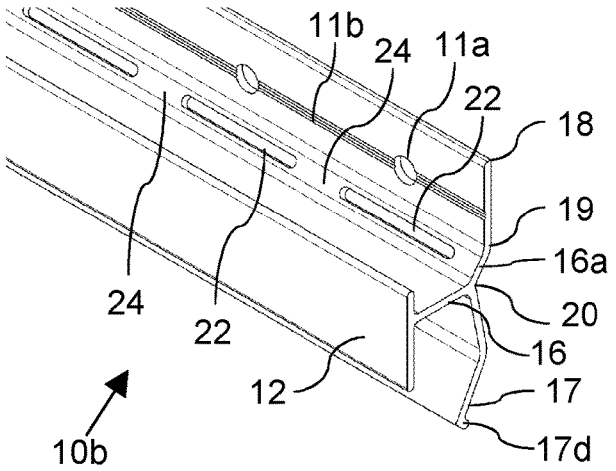
FIG. 4 shows an isometric view of a variant of the FIG. 3 embodiment.

FIG. 4 shows an isometric view of a cladding rail 10*b* that shares many features with the cladding rail 10*a* depicted in FIG. 3. The same numerals are used for corresponding elements. In addition to the illustration of FIG. 3, FIG. 4 shows screw holes 11*a* in the back-fixing rail 15, about half-way between the lower end 19 and the upper end 18, that allow the cladding rail 10*b* to be mounted to a backing structure such as a mullion. The screw holes 11*a* are spaced apart along the longitudinal extension of the cladding rail 10*b* and positioned on a longitudinally extending groove 11*b*. The groove 11*b* facilities inserting the screws into the screw holes 11*a* during assembly by acting as a guide means towards the holes 11*a*.

The cladding rail 10*b* comprises a carrier arm 16 with a Y-branch 20, and a proximal arm portion 16*a* of the carrier arm 16 extends from the lower end 19 at an incline towards the Y-branch 20. Along the longitudinal extent of the proximal arm portion 16*a* there is provided a plurality of elongate slots 22 constituting sound dampening apertures. The slots 22 are spaced apart by bridges 24. Each bridge 24 is about half as long as a slot 22 and so, on average, there is only about one third of material along the array of slots 22 in the cross section of the proximal arm portion 16*a* compared to an arm portion without apertures. As the proximal arm portion 16*a* carries all components that come into contact with the bricks to be provided, the apertures reduce the amount of material capable of relaying vibrations from the tile support 12 onto the back-fixing rail 15.

Figure 5:
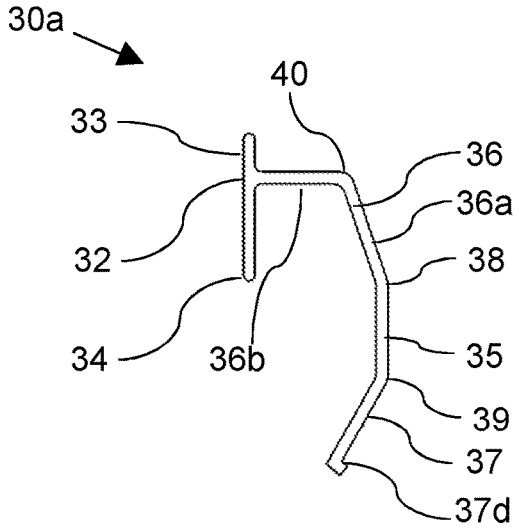
FIG. 5 shows a schematic section of another embodiment.
Figure 6:
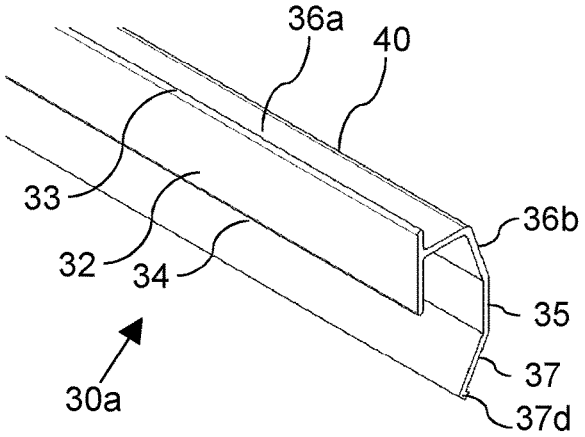
FIG. 6 shows an isometric view of the FIG. 5 embodiment.

FIG. 5 shows a cross section of a cladding rail 30*a* constituting a mounting rail of the invention. FIG. 6 shows an isometric view of the FIG. 5 cladding rail 30*a*. The cladding rail 30*a* is an extruded profile. The cladding rail 30*a* comprises, from the right to the left (right in the reading orientation of FIG. 5, and the right side being the side to be mounted to a mullion), a back-fixing rail 35 with an upper end 38 and a lower end 39. The back-fixing rail 35 is provided to mount the cladding rail 30*a* to a mullion with fixtures such as screws (no screws shown in FIGS. 5 and 6).

The cladding rail 30*a* comprises a carrier arm 36 that extends from the upper end 38 of the back-fixing rail 35. The carrier arm 36 constitutes a tile-carrier support and comprises at its distal end a tile carrier 32, with an upper lip 33 and a lower lip 34. The carrier arm 36 comprises a kink 40 partway (about halfway) between the upper end 38 and the tile carrier 32. Between the kink 40 and the upper end 38, the carrier arm 36 comprises a proximal arm portion 36*a* that is inclined upward at an obtuse angle and, thus, connected to the back-fixing rail 35 at an obtuse angle. Distally of the kink 40 the carrier arm 36 bends down such that a portion of the carrier arm 36 beyond the kink 40, ie a distal arm portion 36*b*, extends practically horizontally between the kink 40 and the tile carrier 32. The distal arm portion 36*b* is practically perpendicular to the vertical plane of the back-fixing rail 35. The kink 40 constitutes an angled bend.

At the lower end 39 the cladding rail comprises a tail 37 constituting a tile-biasing element. The tail 37 extends away from the back-fixing rail 35 at an incline and comprises a back-folded lip 37*d* to provide a smooth contact line with a tile to be provided.

Figure 7:
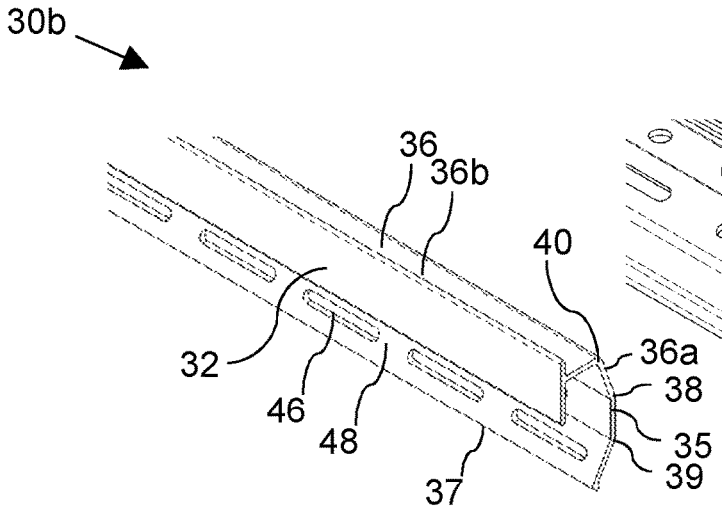
FIG. 7 shows an isometric view of a variant of the FIG. 5 embodiment.

FIG. 7 shows an isometric view of a cladding rail 30*b* that corresponds in profile to the cladding rail 30*a*. The same numerals are used for corresponding elements to facilitate the understanding of the present disclosure. The cladding rail 30*b* comprises a back-fixing rail 35 from whose upper end 38 extends upwardly a carrier arm 36 constituting a tile-support carrier. A proximal arm portion 36*a* is inclined relative to the plane of the back-fixing rail 35 and the carrier arm 36 comprises a bend 40 from where a distal arm portion 36*b* extends horizontally. The distal arm 36*b* portion carries a tile support 32. The upper side of the distal arm 36*b* provides a practically horizontal seating surface for a tile to be provided. From a lower end 39 of the back-fixing rail 35 there extends a tail 37 that constitutes a tile-biasing element. The cladding rail 30*b* corresponds to the cladding rail 30*a* and in addition comprises a plurality of slots 46 arranged longitudinally along the tail 37. The slots 46 are spaced apart by bridges 48. As illustrated in FIG. 7, the bridges 48 have about half the width of the slots 46 and so, compared to the cladding rail 30*a* of FIGS. 5 and 6, there is on average only about a third of material along the array of slots 46 in the cross section of the tail 37. The slots 46 constitute apertures that contribute the acoustic dampening by reducing the amount of material capable of relaying vibrations from the tile support 32 to the back-fixing rail 35.

Figure 8:
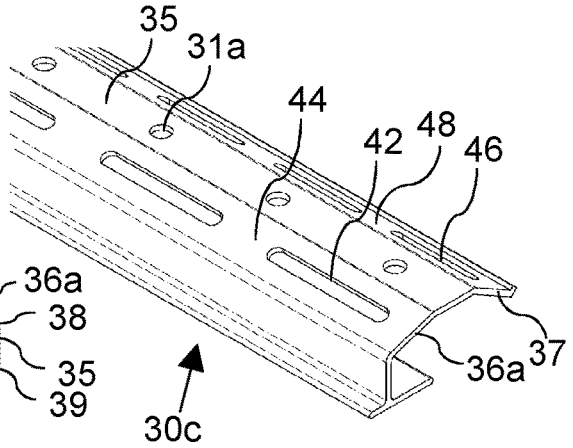
FIG. 8 shows an isometric view of a variant of the FIG. 5 embodiment.

FIG. 8 illustrates a cladding rail 30*c* that constitutes another embodiment of a mounting rail and comprises the features described in relation to FIGS. 5, 6 and 7, and the same numerals are used for equivalent features. FIG. 8 shows a plurality of screw holes 31*a* on the back-fixing rail 35. The screw holes 31*a* are provided to mount the cladding rail 30*c* to a mullion. In addition, the cladding rail 30*c* comprises in the proximal arm portion 36*a*, ie between the upper end of the back-fixing rail 35 and the kink 40, a plurality of slots 42 arranged longitudinally along the proximal arm portion 36*a*. The slots 42 constitute apertures that provide a sound-dampening effect. The slots are spaced apart by bridges 44 and the amount of material required to connect the carrier arm 36 to the back-fixing rail 35 is reduced, correspondingly, relative to a cladding rail without slots. It will be understood that the slots 42 and 46 (described with reference to the FIG. 7 embodiment above) are distinguished from the screw holes 31*a* in that the slots 42 and 46 are not intended to come into abutment with a mullion.

Figure 9:
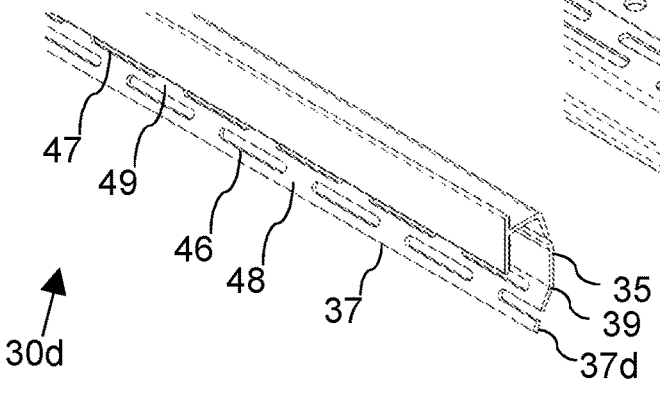
FIG. 9 shows an isometric view of a variant of the FIG. 5 embodiment.

FIG. 9 shows a cladding rail 30*d* constituting another embodiment of a mounting rail. The cladding rail 30*d* comprises features described in FIGS. 5 and 6. The tail 37, between the lower end 39 of the back-fixing rail 35 and the back-folded lip 37*d*, comprises apertures 46 and 47 arranged in a plurality (here: two) rows extending longitudinally in the direction of the cladding rail 30*d*, the apertures 46 arranged in a first row and spaced apart by bridges 48, and the apertures 47 arranged in another row, offset relative to the first row and spaced apart by bridges 49. As the rows of apertures are longitudinally offset, there is no section perpendicular to the longitudinal extension that provides a direct pathway for sound to travel from a tile in contact with the back-folded lip 37 to the backing system.

Figure 10:
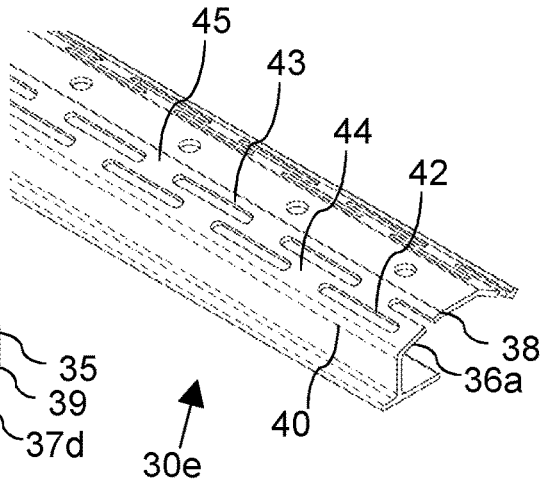
FIG. 10 shows an isometric view of a variant of the FIG. 5 embodiment.

FIG. 10 shows a cladding rail 30*e* constituting another embodiment of a mounting rail. The cladding rail 30*e* comprises features described in FIGS. 5, 6 and 9. In addition, FIG. 10 illustrates an arrangement with a plurality (here: two) rows of apertures extending longitudinally in the direction of the cladding rail 30*e* on the proximal arm portion 36 (between the upper end 38 and the kink 40). Apertures 42 are arranged in a first row and spaced apart by bridges 44. Apertures 43 are arranged in a second row and spaced apart by bridged 45. As the rows of apertures are longitudinally offset, there is no section perpendicular to the longitudinal extension that provides a direct pathway for sound to travel from the tile support to the back-fixing rail.

Figure 11:
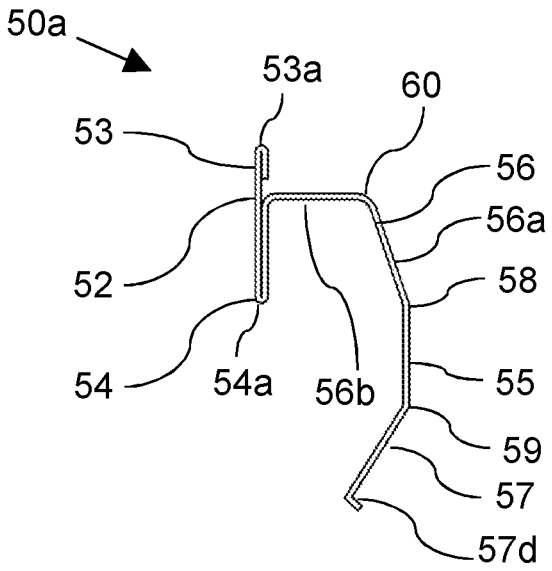
FIG. 11 shows a schematic section of another embodiment.

FIG. 11 shows a cladding rail 50*a* constituting another embodiment of a mounting rail. The cladding rail 50*a* corresponds to the cladding rail 30*a* but is made from sheet metal. The cladding rail 50*a* comprises features corresponding to those described with reference to FIG. 5. From the right to the left (right in the reading orientation of FIG. 11, and the right side being the side to be mounted to a mullion), the cladding rail 50*a* comprises a back-fixing rail 55 with an upper end 58 and a lower end 59. From the upper end 58 extends a carrier arm 56 constituting a tile-carrier support, carrying at its distal end a tile carrier 52. The carrier arm 56 is folded and comprises a bend 60 partway (about halfway) between the upper end 58 and the tile carrier 52. Between the bend 60 and the upper end 58, the carrier arm 56 comprises a proximal arm portion 56*a* that is inclined upward at an obtuse angle and, thus, connected to the back-fixing rail 55 at an obtuse angle. Distally of the bend 60 the carrier arm 56 bends down such that a portion of the carrier arm 56 beyond the kink 40, ie a distal arm portion 56*b*, extends practically horizontally between the bend 60 and the tile carrier 52. The distal arm portion 56*b* is practically perpendicular to the plane of the back-fixing rail 55. The bend 60 constitutes an angled bend. At the lower end 59 the cladding rail 50*a* comprises a tail 57 constituting a tile-biasing element. The tail 57 extends away from the back-fixing rail 55 at an incline and comprises a back-folded lip 57*d* to provide a smooth contacting line with a tile to be provided. The tile carrier 52 comprises an upper lip 53 and a lower lip 54. In contrast to the extruded variant, such as the cladding rail 30*a*, the sheet metal variant provides the lower lip 54 by a first back-fold 54*a* and the upper lip 53 by a second back-fold 53*a*. The back-folds 53*a* and 54*a* provide a smooth contact line with the groove of a tile to be provided.

It will be understood that the cladding rail 50*a* corresponds in principle to the cladding rail 30*a* and so any features described with reference to FIGS. 7 to 10 may be combined with the FIG. 11 embodiment.

Figure 1:
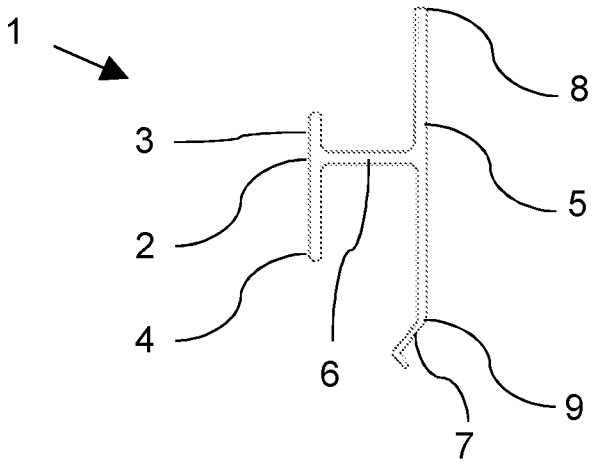
PRIOR ART Fig. 1
FIG. 1 shows a section of a prior art mounting rail.
Figure 2:
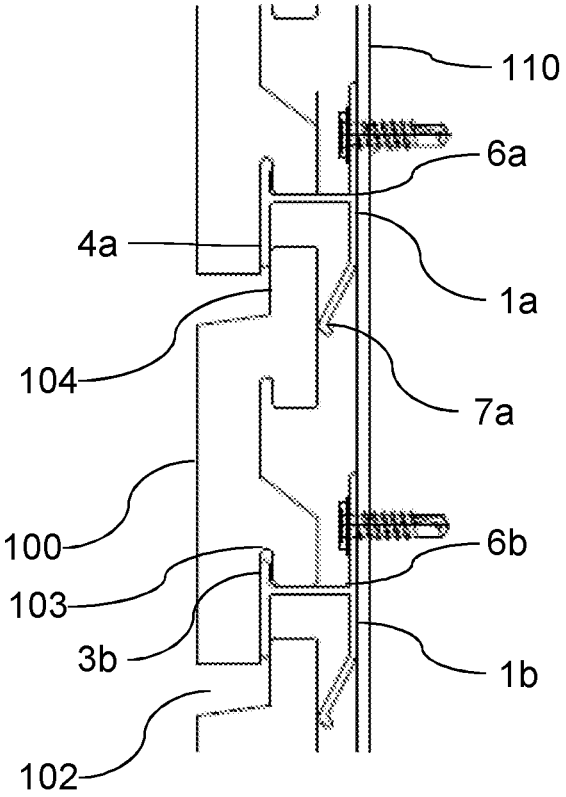
FIG. 2 shows a section of a brick tile structure mounted to a backing system using the FIG. 1 mounting rail design.

The cladding rail embodiments of FIGS. 3 to 11 may be used on a walling structure such as that shown in FIG. 2 instead of conventional mounting rails such as the mounting rail 1 described in FIG. 2. The mounting rail of the invention provides an improved de-coupling of acoustic energy, and as such an improved sound attenuation, while maintaining sufficient structural rigidity.

To provide an illustration of the magnitudes involved, a brick tile may be in the region of 10 cm high and so there may be in the region of 10 metres of cladding rail per square metre. Thus, a purposeful de-coupling of acoustic energy can have a noticeable effect on sound attenuation.

The invention claimed is:

1. A mounting rail for mounting associated tiles to be provided to a backing system of a building wall structure, wherein the mounting rail comprises a tile support, a tile-biasing element to bias one or more of the associated tiles away from the backing system, and a back-fixing rail, wherein the tile support is linked to the back-fixing rail via a tile-support carrier, and wherein the tile support is provided by a distal arm portion perpendicular to a plane of the back-fixing rail, wherein the distal arm portion comprises, in use, an upward-extending lip and a downward-facing lip, that are sufficiently rigid to allow infilling with mortar for an appearance of a brick wall, wherein the tile-support carrier carrying the distal arm portion extends from an upper or lower end, viewed in profile, of the back-fixing rail at an obtuse angle, wherein the obtuse angle is an included angle between the back-fixing rail and a portion of the tile-support carrier connecting to the back-fixing rail, whereby the tile-support carrier comprises an acoustic damper between the tile support and the back-fixing rail.

2. The mounting rail according to claim 1, wherein the acoustic damper comprises an angled bend between the tile support and the back-fixing rail.

3. The mounting rail according to claim 1, wherein the tile-biasing element comprises an acoustic damper.

4. The mounting rail according to claim 3, wherein the acoustic damper of the tile-biasing element comprises an angled bend on the tile-biasing element between a tile-contacting surface and the back-fixing rail.

5. The mounting rail according to claim 3, wherein the tile-biasing element is carried on the tile-support carrier spaced apart from a backing-system contacting plane of the back-fixing rail.

6. The mounting rail according to claim 1, wherein the acoustic damper comprises at least one first aperture and at least one second aperture.

7. The mounting rail according to claim 6, wherein the at least one first aperture and the at least one second aperture are spaced apart in a longitudinal extension of the mounting rail.

8. The mounting rail according to claim 6, wherein one of the at least one first aperture and second aperture is constituted by a slot with an elongate extent in a longitudinal extension of the mounting rail.

9. The mounting rail according to claim 6, wherein the at least one first aperture and the at least one second aperture are constituted by an array of slots arranged sequentially in a longitudinal extension of the mounting rail.

10. The mounting rail according to claim 6, wherein the at least one first aperture and the at least one second aperture apertures are spaced apart by a bridge distance less than a length of at least one of the at least one first aperture and the at least one second aperture.

11. The mounting rail according to claim 6, wherein the at least one first aperture and the at least one second aperture have different shapes and constitute adjacent apertures that are adjacent one another, wherein two or more adjacent apertures are arranged in a sequence of apertures, and the sequence of apertures is repeated along a longitudinal extent of the mounting rail.

12. The mounting rail according to claim 11, wherein the first apertures of the adjacent apertures are of a same shape.

13. The mounting rail according to claim 6, comprising multiples of said first apertures and said second apertures arranged as a plurality of rows of apertures, wherein the apertures of a first row are longitudinally offset from the apertures of a second row.

14. The mounting rail according to claim 5, wherein the mounting rail is formed from extruded metal.

15. The mounting rail according to claim 5, wherein the mounting rail is formed from sheet metal.

16. The mounting rail according to claim 5, wherein the mounting rail is formed from aluminum.

17. The mounting rail according to claim 5, comprised in a walling structure comprising a plurality of mounting rails.

18. The mounting rails according to claim 5, wherein the tile-biasing element comprises a tail portion that extends toward a back-fixing plane defined by a plane of the back-fixing rail, wherein the tail portion is spaced from the back-fixing plane by one millimeter or less.

* * * * *